US005101231A

United States Patent [19]

Saitoh

[11] Patent Number: 5,101,231

[45] Date of Patent: Mar. 31, 1992

[54] IMAGE FORMING APPARATUS

[75] Inventor: Takashi Saitoh, Tokyo, Japan

[73] Assignee: Kabushiki Kaisha Toshiba, Kawasaki, Japan

[21] Appl. No.: 605,845

[22] Filed: Oct. 30, 1990

[30] Foreign Application Priority Data

Oct. 31, 1989 [JP] Japan ..... 1-283749

[51] Int. Cl.[5] ..... G03G 15/06

[52] U.S. Cl. ..... 355/207; 355/246; 118/689

[58] Field of Search ..... 355/246, 251-253, 355/208, 207; 118/656-658, 688-691

[56] References Cited

U.S. PATENT DOCUMENTS 4,977,428 12/1990 Sakakura et al. ..... 355/245

*Primary Examiner*—R. L. Moses

*Attorney, Agent, or Firm*—Foley & Lardner

[57] ABSTRACT

A toner is locally concentrated on a portion of the interior of an image forming apparatus when, e.g., a door of the apparatus is opened/closed or its power source is switched on, resulting in a nonuniform toner concentration. This nonuniform toner concentration is uniformized by consuming the toner within a predetermined time period by forced printing. A variation in toner concentration can be restored at a high speed, thereby preventing formation of a defective image caused by a variation in toner concentration.

6 Claims, 8 Drawing Sheets

IMAGE FORMING APPARATUS

BACKGROUND OF THE INVENTION

1. Field of the Invention

The present invention relates to an image forming apparatus such as a laser printer or an electronic copying machine having a recycling mechanism for returning a toner recovered by a cleaning unit to a developing unit.

2. Description of the Related Art

A laser printer having a recycling mechanism for returning a toner recovered by a cleaning unit to a developing unit has been conventionally developed. In a laser printer of this type, however, since an amount of a toner to be released is temporarily increased by a vibration produced when a cover of a main body is opened/closed to replace a photosensitive body or a fixing unit, a toner concentration in a developing unit becomes nonuniform. Therefore, if the laser printer performs an image forming operation in this state, a defective image is undesirably formed.

For this reason, in an image forming apparatus having such a recycling mechanism, when a cover is opened/-closed, a toner is forcedly circulated to uniformize variations in toner concentration. However, this method of uniformizing a toner concentration by forcedly circulating a toner requires a long time period before the toner concentration is restored to a reference value.

SUMMARY OF THE INVENTION

It is an object of the present invention to provide an image forming apparatus which can rapidly restore a variation in toner concentration to prevent a defective image from being formed by nonuniformity of the toner concentration.

In order to achieve the above object, according to an aspect of the present invention, there is provided an image forming apparatus comprising:

means for developing a latent image with a developer into a developed image on an image bearing member;

means for cleaning the developer remaining on the image bearing member;

means for supplying the developer removed by the cleaning means to the developing means;

means for detecting a density of the developer in the developing means to obtain a density signal having a value corresponding to the density of the developer;

means for comparing the value of the density signal with a reference value;

a power source; and means for driving the developing means when it is determined that the value of the density signal is more than the reference value during the predetermined time period after the power source is turned on.

In order to achieve the above object of the present invention, according to another aspect of the present invention, there is provided an image forming apparatus comprising:

a body containing cover means for covering the body, means for developing a latent image with a developer into a developed image on an image bearing member and means for cleaning the developer remaining on the image bearing member;

means for supplying the developer cleaned by the cleaning means to the developing means;

means for detecting a density of the developer into the developing means to obtain a density signal having a value corresponding to the density of the developer;

means for comparing the value of the density signal with a reference value; and means for driving the developing means when it is determined that the value of the density signal is more than the reference value during the predetermined time period after the front cover means is closed.

In the present invention, since a large amount of toner is consumed by the image forming operation performed by the above means, a mass of a toner can be rapidly removed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

DETAILED DESCRIPTION OF THE PREFERRED EMBODIMENTS

An embodiment of an image forming apparatus of the present invention will be described in detail below with reference to the accompanying drawings.

Figure 1:
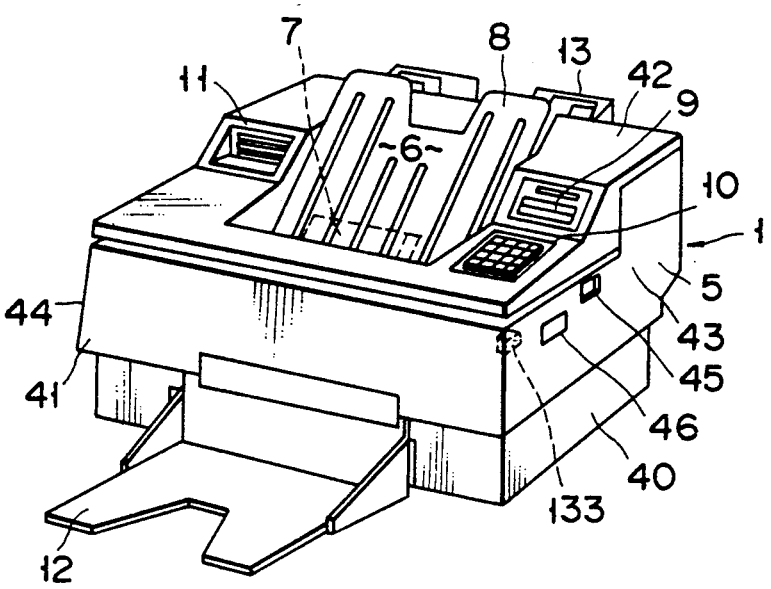
FIG. 1 is a perspective view showing an outer appearance of an image forming apparatus according to the present invention.

FIG. 1 is a perspective view showing an outer appearance of an image forming apparatus of the present invention comprising a laser printer 1 (image forming means) as an image forming unit. The rear portion of an upper surface of a main body 5 of the laser printer 1 is formed higher by a step than its front portion, and a paper discharging portion 6 is formed in a central portion of the upper surface. A paper discharging tray 8 is mounted in the paper discharging portion 6. An operation panel display portion 9 and an operation panel switch portion 10 are arranged at the right side of the paper discharging portion 6, and three IC card insertion slits 11 are formed at the left side thereof. The operation panel display portion 9 is constituted by an LCD display portion for displaying the number of sheets to be printed, an operation mode, and the like, and indicators for indicating various operating states. The operation panel switch portion 10 is constituted by ten keys, an on-line/off-line switching key, a clear key, and the like. A paper discharging tray 12 is mounted on the front surface of the main body 5, and a manual feeding tray 13 is mounted on the rear surface. The outer surfaces of the image forming apparatus are covered with a lower cover 40, a front cover 41, an upper cover 42, a right door cover 43 which can be freely opened/closed, and a left cover 44. A right cover opening/closing lever 45 and an upper unit opening/closing lever 46 are arranged at the right side surface. Reference numeral 133 denotes a door opening/closing switch.

Figure 2:
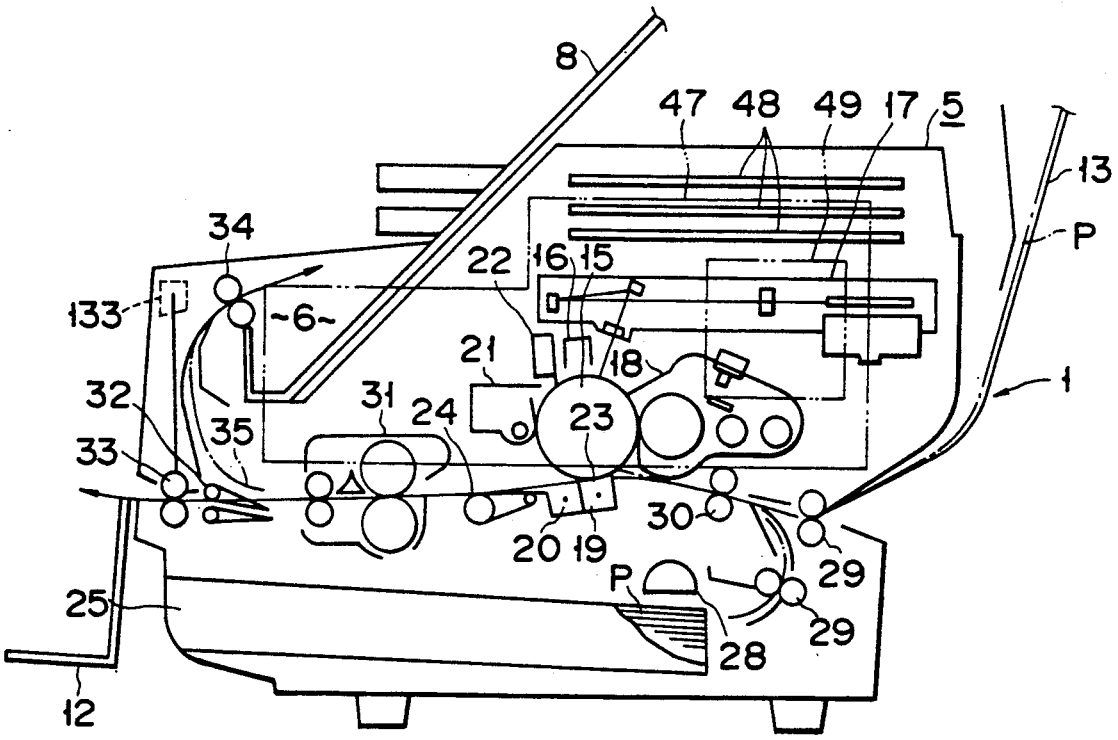
FIG. 2 is a side sectional view showing the image forming apparatus shown in FIG. 1.

FIG. 2 is a side sectional view showing the image forming apparatus shown in FIG. 1. A drum type photosensitive body 15 as an image carrier is located at substantially the central portion of the printer main body 5, and a charger 16, a laser optical system 17, a developer (developing means) 18, a transferring charger 19, a separating charger 20, a cleaner (cleaning means) 21, and a discharger 22 are sequentially arranged around the photosensitive body 15. Paper (transferred material) P which is automatically fed from a paper feed cassette 25 housed in a bottom portion of the printer main body 5 via a paper feed roller 28 and paper P which is manually fed from the manual feeding tray 13 are guided to an image transferring portion 23 between the photosensitive body 15 and the transfer charger 19 via carrying rollers 29 and a pair of aligning rollers 30. An image carrier carrying path 24 extends forward from the image transferring portion 23. A fixing unit 31, a paper discharge selector 32, and paper discharging rollers 33 are arranged at the downstream side of the image carrier carrying path 24. A branched carrying path 35 is formed at the terminal end of the image carrier carrying path 24 to guide the paper P selectively discharged by the paper discharging selector 32 to a paper discharging portion 6 by paper discharging rollers 34. Control boards 47, 48, and 49 constituting a control unit are arranged in the upper portion of the main body 5. The door opening/closing switch (detecting means) 133 is arranged on the inner surface of the right cover 43.

Figure 3:
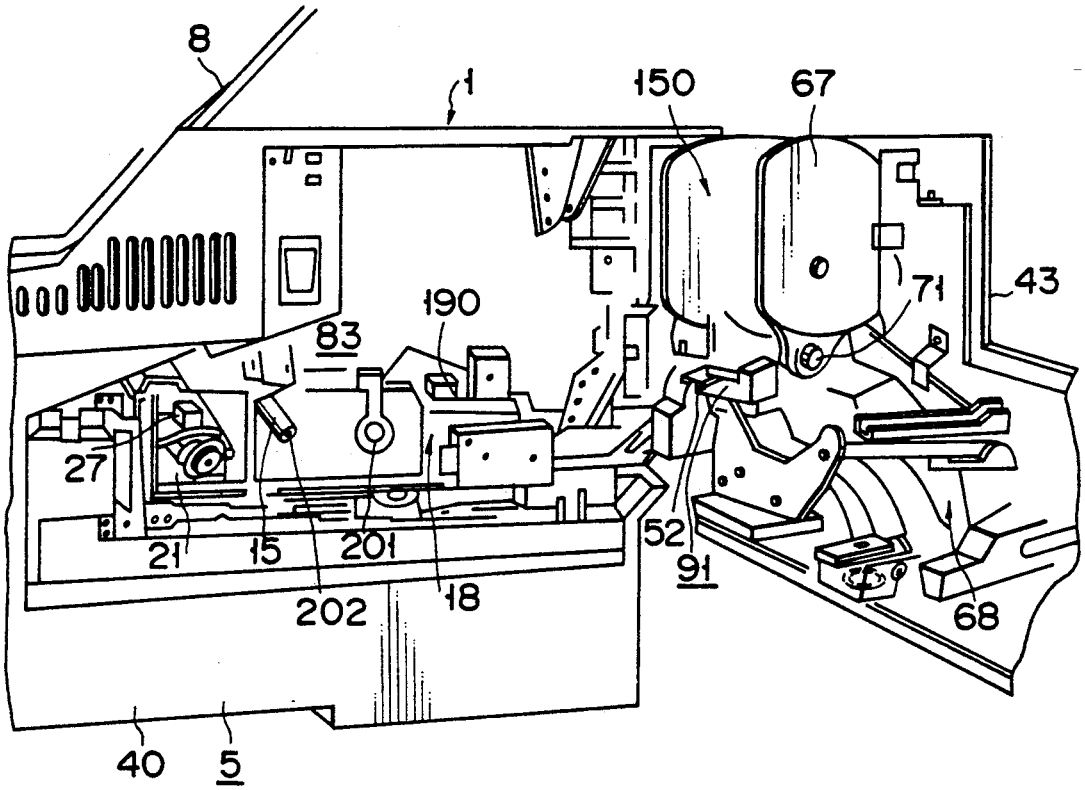
FIG. 3 is a perspective view showing an inner structure of the apparatus shown in FIG. 1 in an open state of a door cover at the right side surface.

FIG. 3 is a perspective view showing an inner structure of the apparatus in a state in which the door cover at the right side surface is open. A toner returning means 68 for returning a toner recovered by the cleaner 21 is mounted on the inner surface of the right cover 43. A driving means of the toner returning means 68, a toner supplementing means 150, and the like are also mounted on the inner surface of the right cover 43. When the right cover 43 is closed, a slide shutter 190 is pushed and slid by a toner releasing portion 91 to open a toner receiving port 66. Reference numeral 67 denotes a toner cartridge; 71, a toner supplementing shaft; 83, a toner releasing portion; 201, a shaft of a developing roller 59; and 202, a shaft of the photosensitive body 15. The toner returning means 68 and the like are described in Japanese Patent Application No. 61-165666 and a detailed description thereof will be omitted.

Figure 4:
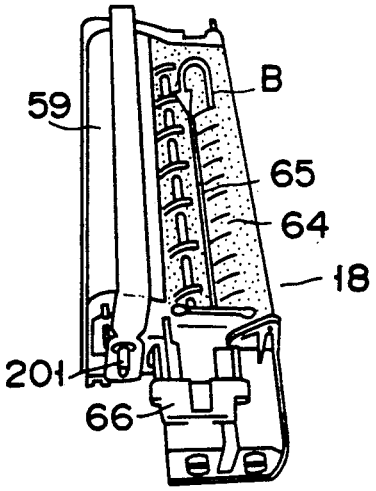
FIG. 4 is a perspective view showing an outer appearance of a developer 18 shown in FIG. 2.

FIG. 4 is a perspective view showing an outer appearance of the developer 18. The developer 18 is constituted by a developing mechanism and a developer agitating portion. The developing mechanism comprises the developing roller 59 located to oppose an opening portion of the main body of the developer, a doctor located on the upstream side of a developing portion to regulate the thickness of a magnetic brush for developer, and a scraper located on the downstream side of the developing portion to scrape the magnetic brush for developer formed on the surface of the developing roller 59 and guide the magnetic brush to the developer agitating portion. The developer agitating portion comprises developer agitators 64 and 65 housed in a developer hopper formed behind the developing roller 59. The toner receiving portion 66 is formed at a position opposing the developer agitating portion. The toner receiving portion 66 is formed so as to receive a toner replenished from the toner cartridge 67 of the developer supplementing means 150 and a toner returned from the cleaner 21 via the toner returning means 68. An arrow B indicates the flow of a developer.

Figure 5:
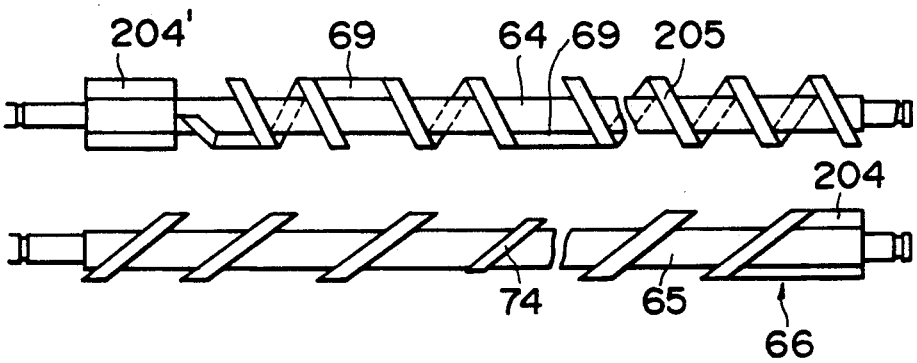
FIG. 5 is a plan view showing arrangements of developer agitators 64 and 65 in the developer 18.

As shown in FIG. 5, the agitator 64 includes a flat U-turn blade 204', carrying blades 205, and agitating blades 69. The agitator 65 includes a flat U-turn blade 204, a blade 74 having a small diameter, and carrying blades 205.

Figure 6:
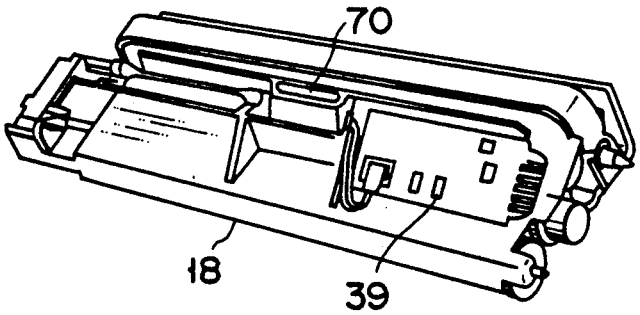
FIG. 6 is a perspective view showing a mounting position of a developer concentration detector 70 of the developer 18.

As shown in FIG. 6, a developer concentration detector (reading means) 70 for detecting a developer concentration is located at a position opposing the scraper. A detection signal from the developer concentration detector 70 is supplied to the board 39 to drive the toner supplementing shaft 71 incorporated in the toner cartridge 67 independently of the printer main body 5 as needed.

Developer concentration detection and concentration control will be described below. As shown in FIG. 6, the board 39 and the concentration detector 70 are connected to the developer 18 as a means for checking whether the unit is new or old or for recognizing the manufacturing No. thereof. In the following description, assume that the developer 18 is new. A developer has a predetermined concentration in advance, and the board 39 checks whether the developer 18 is new or old when the developer 18 is mounted on the printer main body 5. Only when the developer 18 is determined to be new, a recording unit (not shown) of the printer main body 5 resets a use count of the developer 18 in the main body 5. Thereafter, driving of only the main body is started while the concentration of the developer is kept at predetermined level. After about two minutes during when the flow of the developer is stabilized, the recording unit (not shown) of the printer main body 5 reads a voltage value converted from a concentration value from the board 39. At this time, concentration control of the developer 18 is started with reference to the read voltage value.

The cleaner 21 shown in FIGS. 2 and 3 has an opening portion at a position opposing the photosensitive body 15, and a cleaning blade is housed in the opening portion. The upper end portion of the cleaning blade is held by a blade holder which can pivot about a supporting shaft and is normally biased by a weight as a biasing member, and its lower distal end is urged against the circumferential surface of the photosensitive body 15. The cleaning blade scrapes a remaining toner attracted to the photosensitive body 15. A recovering blade is mounted on the peripheral portion of the lower opening end of the opening portion to collect the toner scraped by the cleaning blade into the main body of the cleaner 21. A toner recover auger is disposed in the bottom of the main body of the cleaner 21 to transfer the toner in the main body of the cleaner 21 to the toner releasing portion 83 extending outward so as to give the toner to the toner returning means 68.

Figure 7:
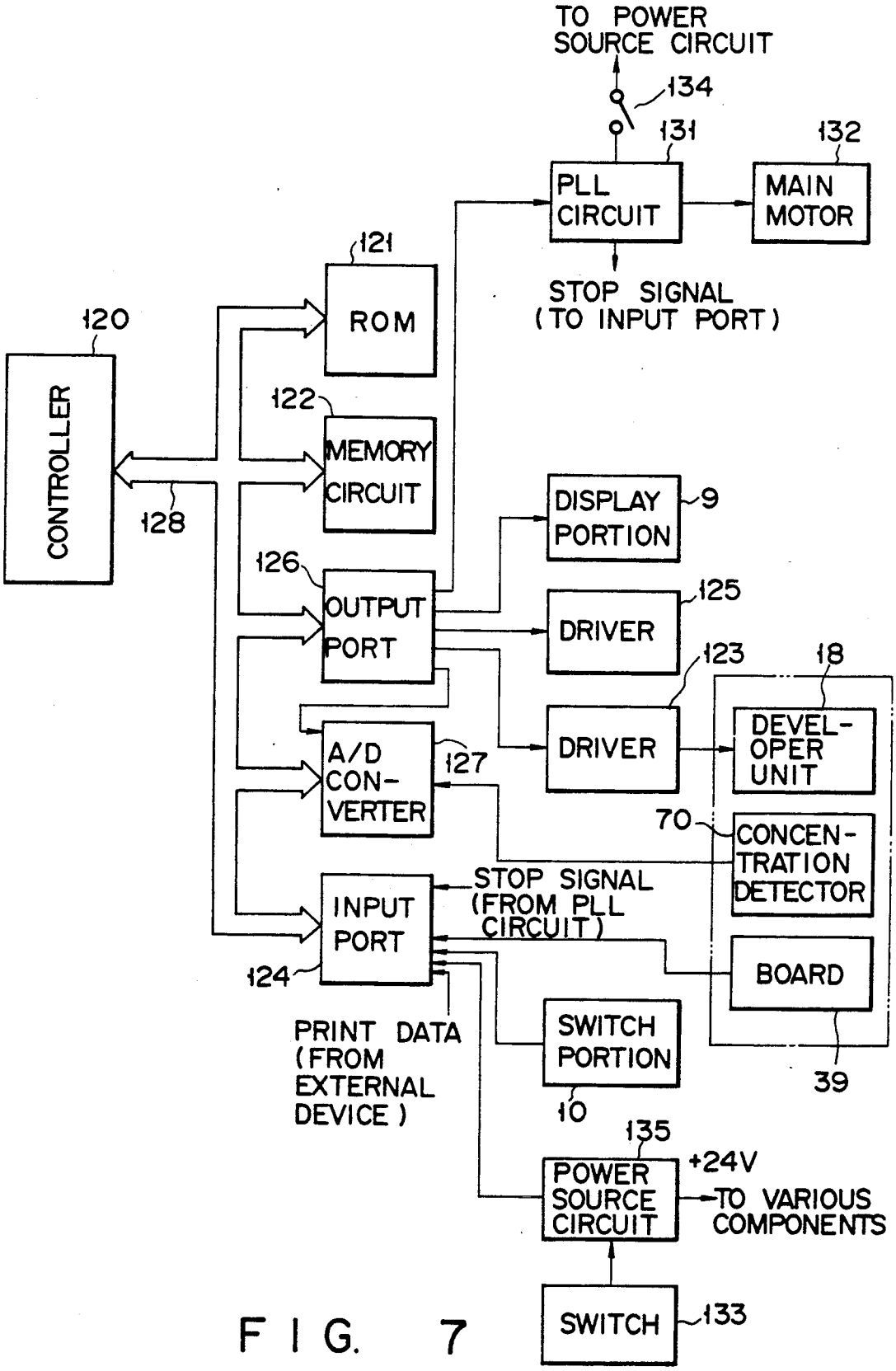
FIG. 7 is a block diagram showing a main part of an electric circuit of the image forming apparatus shown in FIG. 1.

FIG. 7 is a block diagram showing a main part of an electric circuit of the image forming apparatus. A controller (control means) 120 for controlling the overall apparatus is connected to a ROM 121, a memory circuit 122, an input port 124, an output port 126, and an A/D converter 127 via a bus 128. The ROM 121 stores control programs. The memory circuit 122 is constituted by a nonvolatile RAM and stores various types of data. The input port 124 receives, e.g., a stop signal from a PLL circuit 131 for controlling a main motor 132, printing data supplied from the external equipments, a state signal of a power source circuit 135, and a signal from the board 39. The power source circuit 135 stops an output of a power source voltage (+24 V) to each portion by using the cover switch 133 which is turned on/off in accordance with closing/opening of the right cover 43. The output port 126 outputs display contents to the operation panel display portion 9, outputs a drive signal to a driver 125 for driving a toner supplementing motor, outputs a control signal to the PLL circuit 131, and outputs a drive signal to a driver 123 for driving the developer 18. The A/D converter 127 converts a concentration signal from the concentration detector 70 into a digital value.

An operation of the image forming apparatus having the above arrangement will be described below.

In an image forming operation, the photosensitive body 15 is driven and uniformly charged by the charger 16, and the laser optical system 17 performs exposure corresponding to an image signal on the photosensitive body 15, thereby forming an electrostatic latent image. The electrostatic latent image formed on the photosensitive body 15 is developed by the developer 18 using a two-component developer consisting of a toner and a carrier, and supplied as a toner to the image transferring portion 23.

Paper P automatically fed from the paper feed cassette 25 in synchronism with the above toner image forming operation or manually fed paper P is supplied via the aligning rollers 30, and the toner image formed on the photosensitive body 15 is transferred onto the paper P by the transfer charger 19. The paper P is separated from the photosensitive body 15 by the separating charger 20 and supplied to the fixing unit 31 through the image carrier carrying path 24. The toner image is melted and fixed on the paper P by the fixing unit 31, and the paper P is selectively delivered to the upper paper discharging tray 8 or the front paper discharging tray 12 by the paper discharging selector 32. After the toner image is transferred onto the paper P, a remaining toner on the photosensitive body 15 is removed by the cleaner 21 to enable the next copying operation.

When an opening/closing operation of the right cover 43, for example, is performed in order to replace a unit of the photosensitive body 15 or the fixing unit 31, a toner is moved and locally concentrated between the interior of the toner returning means 68 and the cleaner 21 due to a vibration produced upon the opening/closing operation. As a result, an amount of toner released from the toner releasing portion 83 is temporarily increased. Therefore, if a printing operation is started in this state, a defective image is formed due to nonuniformity in toner concentration.

Figure 8:
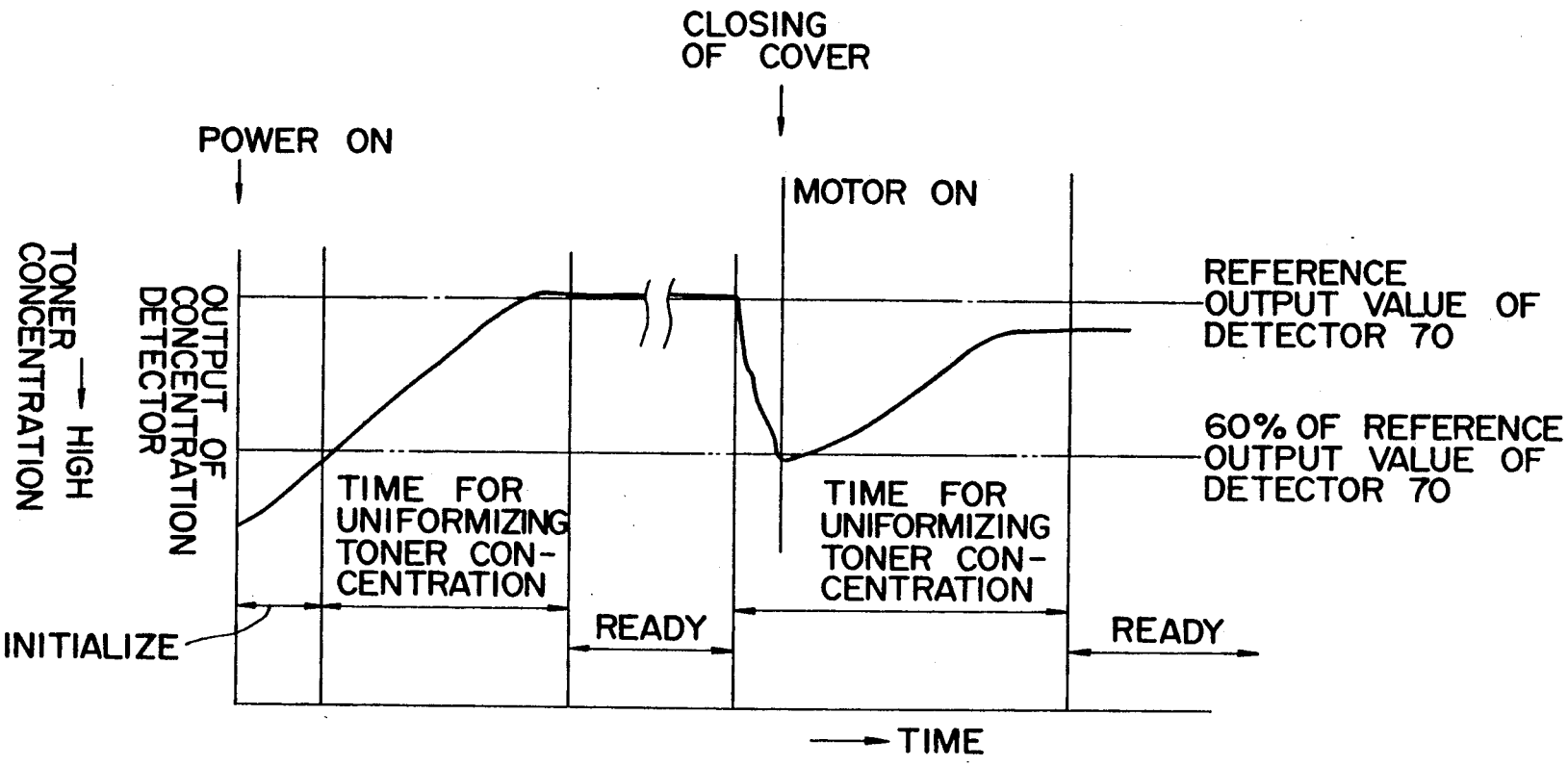
FIG. 8 is a graph for explaining conventional uniformization of a toner concentration performed by forced circulation of a toner.

FIG. 8 is a graph for explaining uniformization of a toner concentration performed by conventional toner forced circulation. FIG. 8 shows a restoration time of a toner concentration obtained, after a cover is opened/-closed, when a motor (not shown) is rotated to forcedly circulate a toner in order to avoid non-uniformity of a toner concentration, thereby eliminating variations in toner concentration. A temporarily increased amount of toner is supplied from the toner releasing portion 83 to the developer 18 via the toner returning means 68 and is agitated to be uniformized in the developer 18. Therefore, a long time period is required before the motor is operated to uniformize the toner concentration after the cover is closed. In addition, even if the toner concentration is uniformized, since the toner amount in the developer 18 is larger than a reference value of an output from the concentration detector 70 and thus the concentration is high, an influence of, e.g., a high background concentration occurs.

Figure 9:
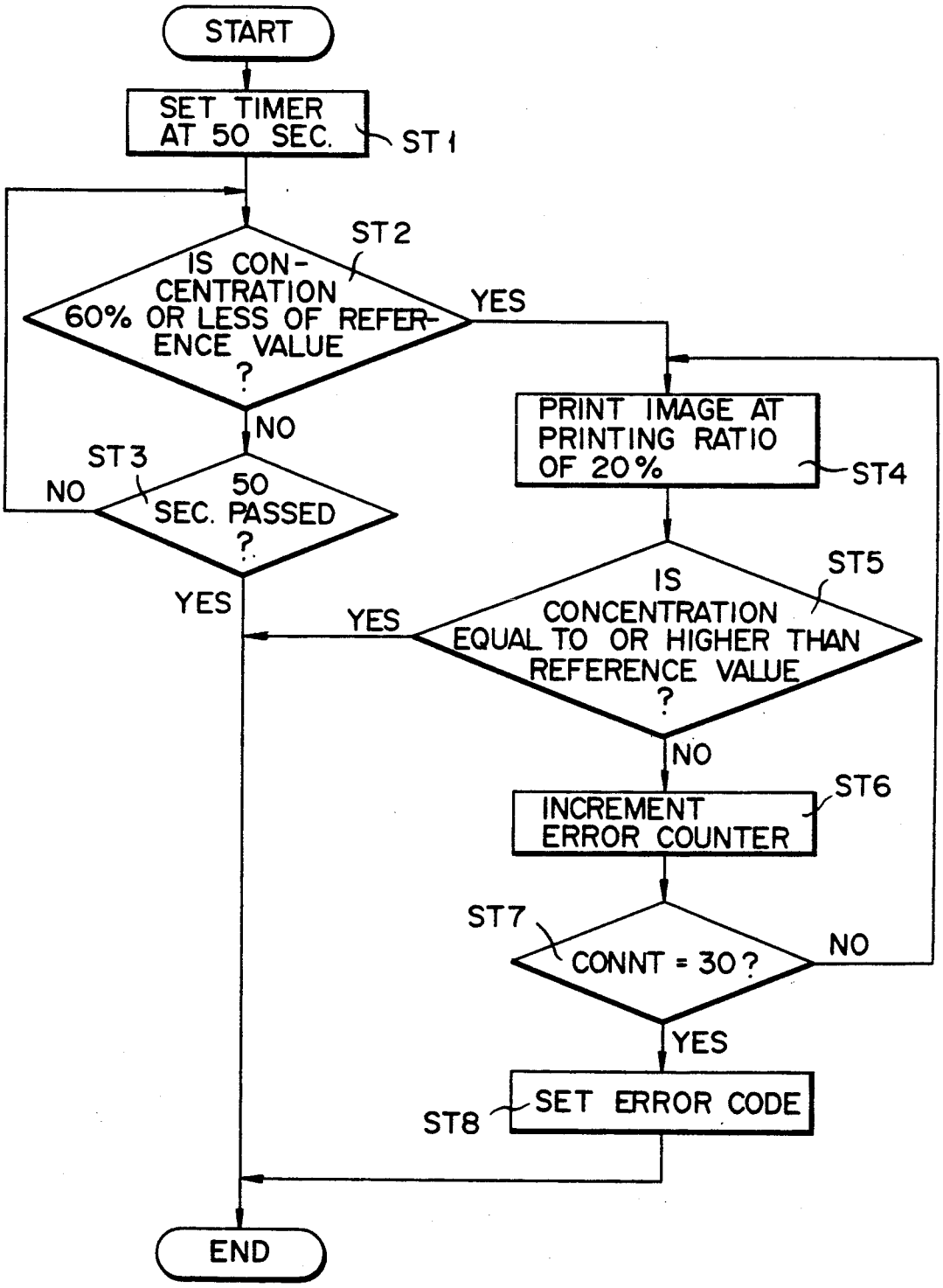
FIG. 9 is a flow chart for explaining a sequence of uniformizing a toner concentration performed by forced printing according to the present invention.

Uniformization of a nonuniform toner concentration performed by consuming a toner by forced printing according to the present invention will be described below with reference to FIG. 9. A routine shown in FIG. 9 is performed after image forming equipment is except for the developer 18 are set in a ready state when the cover is closed or the power source is switched on. In the following description, assume that the cover switch 133 is closed.

When closing of the right cover 43 is detected by the cover switch 133, a time interval of, e.g., 50 seconds is set in an internal timer (timer means) 120*a* of the controller 120 (ST1). The concentration detector 70 reads a toner concentration as a voltage. The controller 120 checks before 50 seconds elapse in the timer 120*a* (ST3) whether an output signal level of the concentration detector 70 is smaller than 60% of a reference value (ST2). If the value of the toner concentration is larger than 60% of the reference value after 50 seconds elapse, this routine is ended. If the controller 120 determines that the value of the toner concentration is smaller than 60% (that the toner concentration is high), it controls the main motor 132, the driver 125, and the like to forcedly print an image having a printing ratio of, e.g., 20% (ST4). After this printing operation, the toner concentration is read by the concentration detector 70 to check whether the toner concentration is the reference value or more (ST5). If the value of the toner concentration is smaller than 60% of the reference value, an error counter is incremented (ST6). The controller 120 checks whether the error counter counts up to 30 (ST7). If the count is less than 30, the flow returns to the step ST4. In this manner, the above operation is repeatedly performed until the output signal level from the concentration detector 70 becomes equal to the reference value or more, i.e., until the toner concentration becomes low. If the toner concentration is not restored even after the number of images obtained by the printing operation reaches 30 (ST7), the controller 120 determines that a trouble occurs and sets an error code (ST8), thereby ending the routine.

Figure 10:
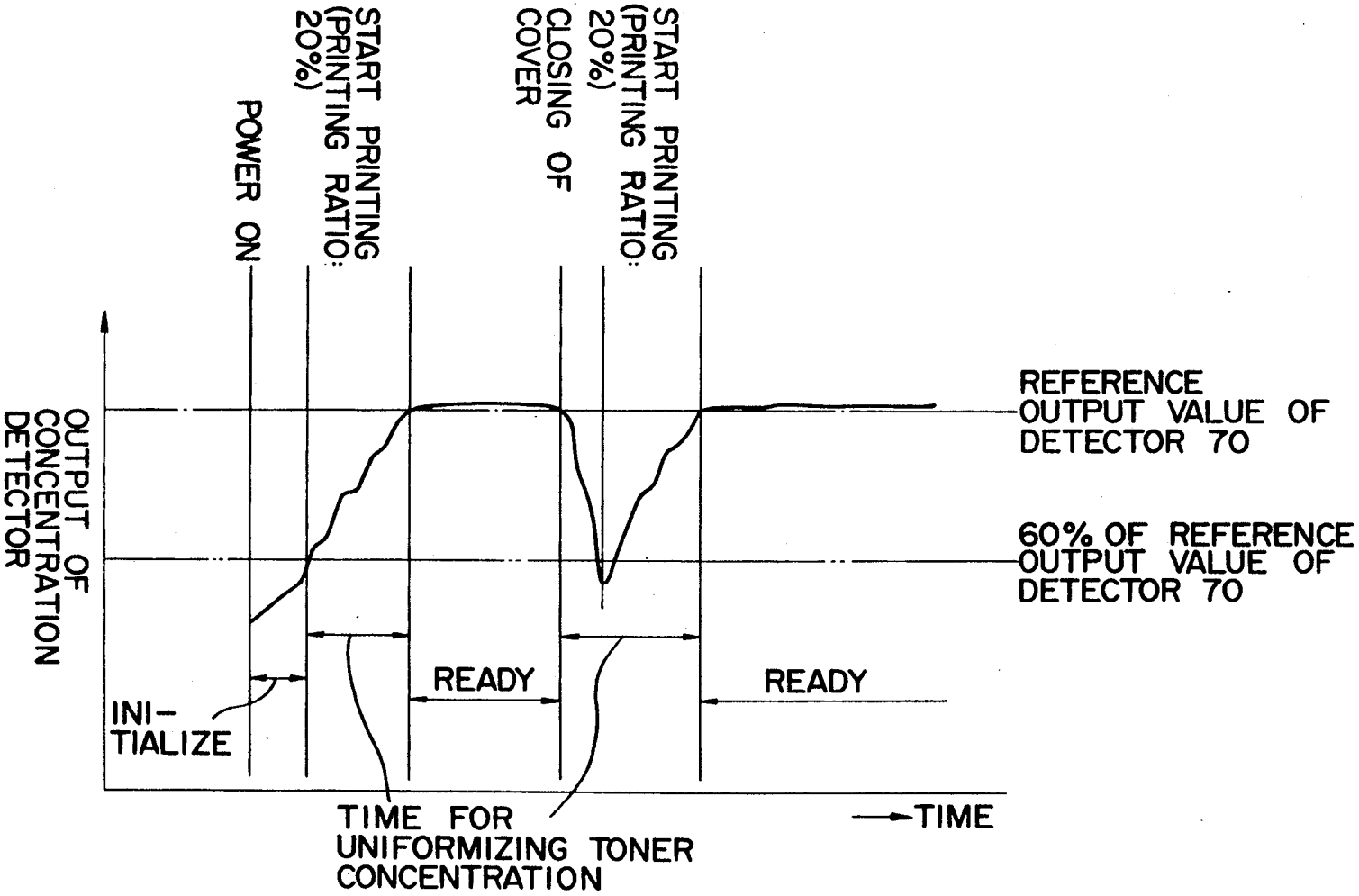
FIG. 10 is a graph for explaining uniformization of a toner concentration performed by forced printing according to the present invention.
Figure 11A:
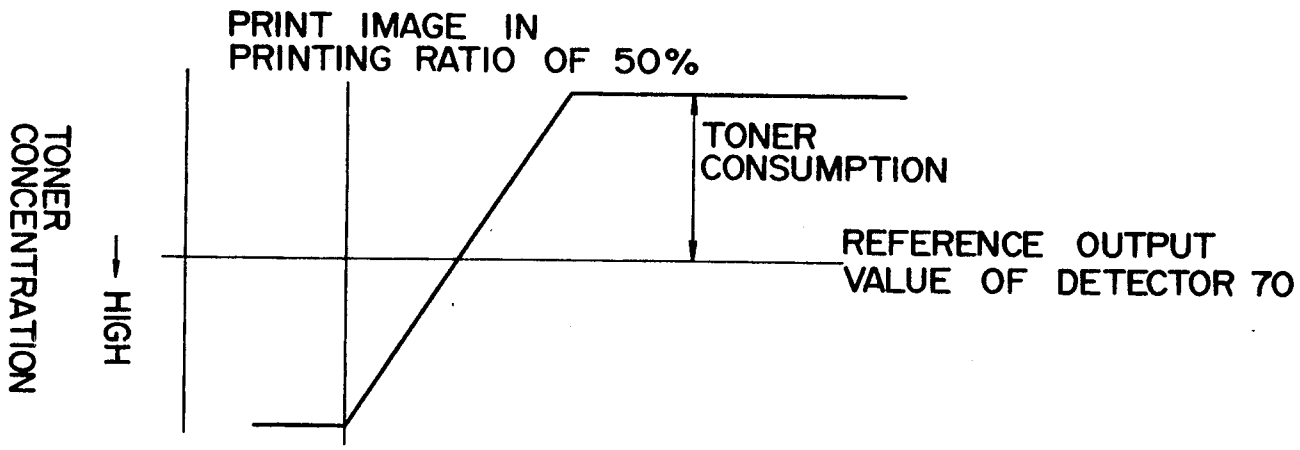
FIGS. 11A and 11B are graphs showing variation in toner concentration caused by a difference between printing ratios.
Figure 11B:
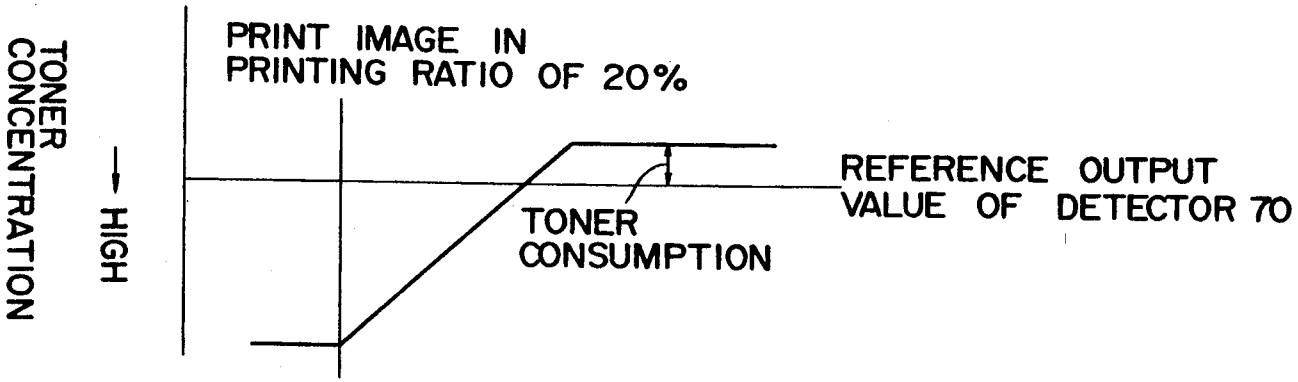

FIG. 10 is a graph for explaining uniformization of a toner concentration performed by forced printing according to the present invention. When printing is performed at a printing ratio of 20%, an output from the concentration detector 70 can be rapidly raised to shorten a restoration time, and the toner concentration can be restored within a control range at a high speed. As a result, formation of a defective image caused by a variation in toner concentration can be prevented.

When forced printing is performed, an amount of toner to be consumed is increased as a printing ratio of an image to be printed is increased. Therefore, a mass of toner concentrated at one portion can be removed at a high speed. As shown in FIG. IIA, however, when an image having a printing ratio of, e.g., 50% is printed, a consumption amount of toner is increased too much to largely exceed the reference value. On the other hand, if the printing ratio is too small, the number of printed images required for restoration is increased to make it difficult to perform restoration at a high speed and to thus increase the number of wasted sheets of paper. To the contrary, when the printing ratio is set to be about 20% as shown in FIG. IIB, a consumption amount of toner is not so much, and the toner concentration can be easily set within the control range when restoration is completed.

In the above embodiment, a transfer time required before a toner in an amount increased by a vibration of, e.g., opening/closing of the cover is detected by the concentration detector is set to be 50 seconds. However, this time is not limited to 50 seconds but may be changed in accordance with the characteristics of an apparatus.

In addition, in order to avoid erroneous determination caused by a concentration ripple, when a toner supplementing amount is large due to printing performed by opening/closing of the cover or switching ON of the power source before main control is started, the reference value of the determination level is set to be 60%. However, this condition can be changed in accordance with the state of an apparatus or an operating condition or operating environment.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. An image forming apparatus comprising:

means for developing a latent image with a developer into a developed image on an image bearing member;

means for cleaning the developer remaining on the image bearing member;

means for supplying the developer removed by the cleaning means to the developing means;

means for detecting a density of the developer in the developing means to obtain a density signal having a value corresponding to the density of the developer;

means for comparing the value of the density signal with a reference value;

a power source; and means for driving the developing means when it is determined that the value of the density signal is more than the reference value during the predetermined time period after the power source is turned on.

2. An apparatus according to claim 1, wherein said driving means includes means for performing error setting when said density of said developer in said developing means exceeds said reference value even after the image forming apparatus performs a predetermined image forming operation.

3. An apparatus according to claim 1, further including means for stopping said driving means when said predetermined time period has elapsed even if said density of said developer in said developing means exceeds said reference value.

4. An image forming apparatus comprising:

a body containing cover means for covering the body, means for developing a latent image with a developer into a developed image on an image bearing member and means for cleaning the developer remaining on the image bearing member;

means for supplying the developer cleaned by the cleaning means to the developing means;

means for detecting a density of the developer into the developing means to obtain a density signal having a value corresponding to the density of the developer;

means for comparing the value of the density signal with a reference value; and means for driving the developing means when it is determined that the value of the density signal is more than the reference value during the predetermined time period after the front cover means is closed.

5. An apparatus according to claim 4, wherein said driving means includes means for performing error setting when said density of said developer in said developing means exceeds said reference value even after said image forming apparatus performs a predetermined image forming operation.

6. An apparatus according to claim 4, further including means for stopping said driving means when said predetermined time period has elapsed even if said density of said developer in said developing means exceeds said reference value.

* * * * *